United States Patent [19]

Smith et al.

[11] Patent Number: 4,856,582

[45] Date of Patent: Aug. 15, 1989

[54] MOTORIZED WELLBORE FISHING TOOL

[75] Inventors: Lonnie E. Smith, Allen; Thomas Schasteen, Garland, both of Tex.

[73] Assignee: Atlantic Richfield Company, Los Angeles, Calif.

[21] Appl. No.: 221,831

[22] Filed: Jul. 20, 1988

[51] Int. Cl.[4] ..... E21B 31/18

[52] U.S. Cl. ..... 166/98; 166/301; 294/86.14; 294/86.33

[58] Field of Search ..... 166/98, 237, 301, 385; 294/86.1, 86.14, 86.17, 86.21, 86.26, 86.33

[56] References Cited

U.S. PATENT DOCUMENTS

| | | | |
|---|---|---|---|
| 2,427,438 | 9/1947 | Breaux | 294/86.33 X |
| 2,794,670 | 6/1957 | Menegus et al. | 294/86.14 |
| 2,954,258 | 9/1960 | Cook | 294/86.33 X |
| 3,741,601 | 6/1973 | Ridley | 294/86.33 X |
| 4,591,197 | 5/1986 | Akkelmann | 294/86.33 X |

*Primary Examiner*—William P. Neuder

*Attorney, Agent, or Firm*—Michael E. Martin

[57] ABSTRACT

A motor operated fishing and setting tool for wellbore instruments and apparatus includes a tubular body member, a lower guide member having a conical surface formed therein and an inner sleeve with an elongated bore for receiving a fishing head. The fishing head includes an annular groove for receiving plural ball keys which are retained in openings formed in the inner sleeve member. The ball keys are controlled by an outer sleeve member movable between a position for forcibly holding the ball keys in registration with the groove in the fishing head and a retracted and radially outwardly displaced position to permit uncoupling of the fishing head from the tool.

7 Claims, 2 Drawing Sheets

MOTORIZED WELLBORE FISHING TOOL

BACKGROUND OF THE INVENTION

1. Field of the Invention

The present invention pertains to a wireline conveyed fishing tool for setting and retrieving wellbore apparatus and characterized by a motor-activated sleeve which retains and releases movable ball keys with respect to a grooved fishing head on the wellbore apparatus.

2. Background

In many wellbore operations, it is desirable to be able to place a tool or instrument in the wellbore at a selected point and retrieve the tool or instrument at a later time. Although various types of wellbore equipment setting and retrieving tools have been developed, there has been a continuing need for a relatively uncomplicated and reliable setting and retrieving or "fishing" tool which may be conveyed into and out of the wellbore on the lower end of a flexible cable or "wireline" or other suitable conveying means including coilable metal tubing and the like. It is to this end that the present invention has been developed with a view to providing a unique setting and retrieving tool for placing wellbore tools and instruments in selected positions in a wellbore.

SUMMARY OF THE INVENTION

The present invention provides a motor-activated fishing tool for use in placing and retrieving wellbore apparatus within a wellbore at selected points of release, for example.

In accordance with one aspect of the present invention, there is provided a combination of a unique wellbore apparatus fishing head and a motor-activated fishing tool which may be conveyed into and out of a wellbore on the end of a flexible cable or "wireline" or on one end of a coilable tube or the like.

In accordance with another aspect of the present invention, there is provided a motor-activated tool for setting and releasing wellbore apparatus wherein an elongated axially movable sleeve is adapted to control the position of a plurality of ball keys so that said keys may be positioned to be in locking engagement with a head member or to release the head member for placement of the wellbore apparatus and retrieval of the fishing tool.

In accordance with still a further aspect of the present invention, there is provided a wellbore fishing tool useful for setting and retrieving or "fishing" wellbore apparatus wherein an inner sleeve member and a guide member on the tool cooperate to locate a head member connected to the wellbore apparatus or instrument for easily capturing the head member and wherein an axially movable outer sleeve member is disposed in sleeved relation over the inner sleeve member and is movable between a position for locking the fishing tool to the head member and unlocking the fishing tool from the head member, respectively. The head guide or entry member is also adapted for easy removal from the fishing tool so that selected alternate versions of the guide head member may be used, depending on the diameter of the wellbore casing or tubing in which the fishing tool is disposed during its operation.

In accordance with yet a further aspect of the present invention, a mechanically uncomplicated and reliable motor operated fishing tool is provided which is relatively insensitive to the presence of wellbore fluids or debris thereby minimizing the chance of interference with operation of the tool in normal wellbore operations.

Those skilled in the art will recognize the above-described features and advantages of the present invention together with other superior aspects thereof upon reading the detailed description which follows in conjunction with the drawing.

DESCRIPTION OF A PREFERRED EMBODIMENT

Figure 1:
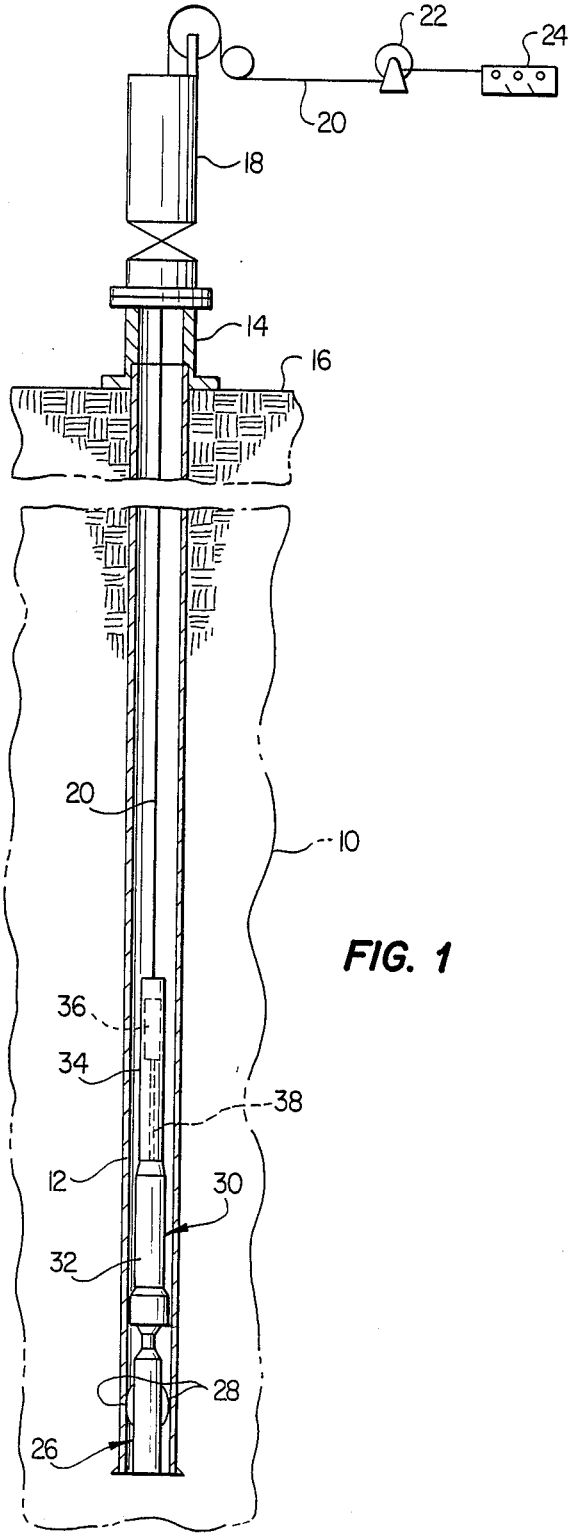
FIG. 1 is a vertical section view of a wellbore in somewhat schematic form showing a wellbore apparatus being placed or retrieved by the improved fishing tool of the present invention.
Figure 2A:
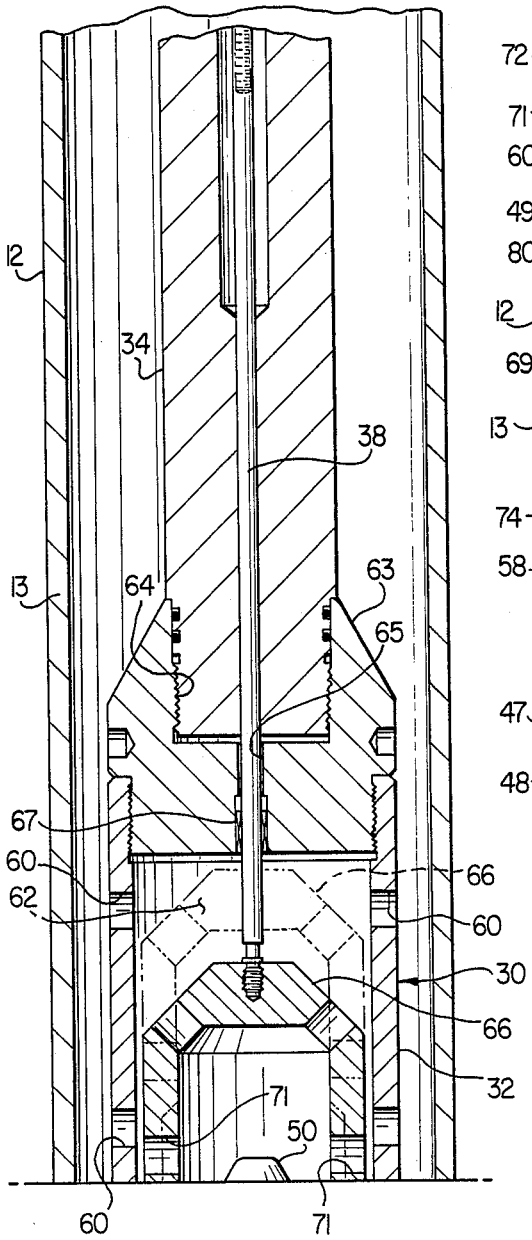
FIGS. 2*a* and 2*b* comprise a longitudinal central section view of the fishing tool and head member of the present invention.
Figure 2B:
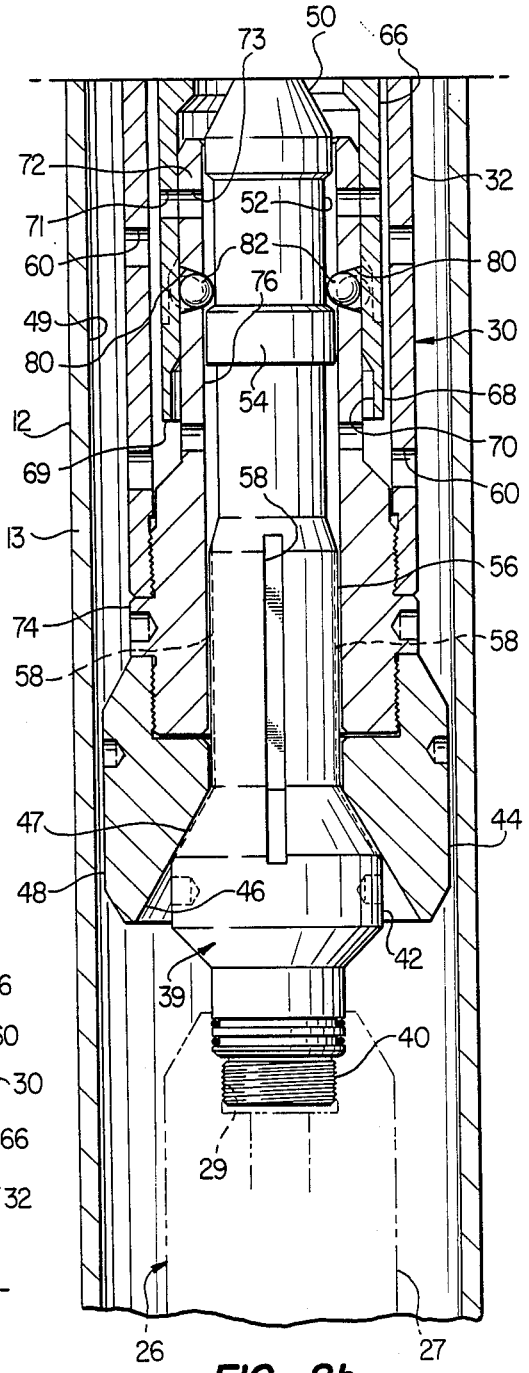

In the description which follows like parts are marked throughout the specification and drawing with the same reference numerals, respectively. The drawing figures are not necessarily to scale and certain elements may be shown in somewhat schematic form in the interest of clarity and conciseness.

Referring now to FIG. 1, there is illustrated, in somewhat schematic form, an earth formation 10 having a cased wellbore 12 extended thereinto. A conventional wellhead 14 is disposed at the earth's surface 16 and supports a conventional wireline lubricator and stuffing box 18 familiar to those of skill in the art of wellbore structures. The lubricator 18 is adapted to extended an elongated flexible cable or wireline 20 into the wellbore 12. The cable 20 terminates at one end on a suitable reel or drum 22 which is adapted to be in communication with the cable 20 in such a way as to permit the transmission of electrical signals between the cable 20 and a control unit 24.

In many operations, such as in formation stimulation and wellbore testing, it is desirable to place certain tools or instruments in the wellbore temporarily to measure pressure, temperature, and other parameters of the fluids and other substances present in the wellbore or parameters pertaining to certain properties of the formation. In FIG. 1, there is illustrated a wellbore instrument 26 which is disposed at the bottom of the wellbore 12 and includes suitable centralizing springs 28 thereon to assist in positioning the instrument generally centrally within the wellbore. The instrument 26 is shown connected to an improved and unique setting and retrieving or "fishing" tool, generally designated by the numeral 30. The fishing tool 30 is shown connected to the instrument 26 and may, in the position shown, be operably in a condition to release from the instrument 26 for retrieval of the fishing tool by the wireline cable 20 or to retrieve the instrument 26 upon lifting the tool 30 by the wireline.

As further shown in FIG. 1, the tool 30 includes a generally cylindrical body member 32 with an upper extension body member 34 suitably connected thereto. The upper end of the extension member 34 is suitably connected to the wireline 20 by conventional means, not shown in detail. The extension member 34 is adapted to support motor means 36 suitably connected to a shaft member 38 disposed within the extension member and extending into the housing 32 as will be described in further detail in conjunction with the description of the structure illustrated in FIGS. *2a* and *2b*. Suffice it to say that the motor means 36 may be, for example, an electrical motor of a rotary or linear type which is adapted to effect axial movement of the shaft 38 in opposition directions from control signals conveyed along the wireline 20 from the control unit 24 to effect operation of connecting or disconnecting the fishing tool with respect to the instrument 26. It should be noted also that the arrangement of placing the instrument 26 in the wellbore 12 in FIG. 1 is merely illustrative. The instrument 26 or other suitable wellbore apparatus may also be placed in an open hole wellbore utilizing the improved tool 30 or the instrument 26 or a similar apparatus may be placed at selected points within a drill pipe, tubing string, riser pipe or other conduit.

Referring now to FIGS. *2a* and *2b*, the instrument 26 includes a suitable housing 27 having an upper distal end provided with a central axial bore including a threaded portion 29 for receiving a unique fishing head, generally designated by the numeral 39. The head 39 includes a lower end 40 which is threaded and adapted to be threadedly engaged with the housing 27 as illustrated and is also provided with an enlarged diameter plug portion 42 engagable with a lower centralizing and guide member 44 on the fishing tool 30. The guide member 44 includes a frustoconical surface 46 and a generally cylindrical outer surface 48 delimiting the guide member and adapted to be slightly smaller in diameter than the inner wall surface 49 of the wellbore casing 13.

Referring further to FIG. *2b*, the head member 38 includes a generally frustoconical upper nose portion 50 and a circumferential, axially extending groove 52 formed between the nose portion and a collar portion 54. A further reduced diameter portion 56 is formed between the collar 54 and the plug portion 42 and includes axially extending grooves 58 forming fluid relief ports. The guide member 44 is engagable with a cooperating conical surface 47 on the plug member 42 for delimiting the movement of the fishing head 39 into the head receiving end of the fishing tool 30. The grooves 58 extend along the surface 47.

The tubular outer body member 32 of the tool 30 is provided with a plurality of ports 60 formed therein and opening into the interior 62 of the body member so that wellbore fluid may flow freely into and out of the body member. The body member 32 is threadedly connected at its upper end to an end part 63 which is provided with a threaded bore portion 64 for receiving the lower end of the extension member 34. The extension member 34 may comprise a generally cylindrical tubular housing which contains the motor means 36, not shown in FIG. *2a*, and a portion of the shaft 38 extending thereinto. The shaft 38 also extends through a suitable bore 65 formed in the end part 63 and into the interior 62 of the body member 32. Suitable bearing means 67 are disposed in the bore 65 for journaling the shaft 38. The shaft 38 is threadedly coupled to an elongated outer sleeve member 66 having a lower end 68 which includes an annular recess 70 formed therein and opening to a transverse end face 69. The sleeve 66 is adapted for axial reciprocating movement within the body member 32 in response to movement of the shaft 38.

The sleeve 66 is formed with plural fluid transfer ports 71 to permit free flow of wellbore fluid out of the interior space formed between the sleeve member 66 and an inner sleeve member 72. The inner sleeve member 72 is formed integral with a lower end part 74 which is threadedly coupled to the body part 32 and to the guide member 44. The inner sleeve member 72 is defined in part by a cylindrical bore 76 in which the fishing head 50 is slidably disposed. The inner sleeve member 72 also includes a plurality of circumferentially spaced radially extending openings 80 for receiving suitable ball keys 82 therein. The openings 80 are somewhat conical or tapered radially inwardly and the ball keys 82 are dimensioned such that the ball keys are only partially extendable into the bore 76 in registration with the groove 52 to prevent disengagement of the head 39 from the tool 30 when the sleeve 66 is disposed in the position shown by the solid lines in FIG. *2b*.

In the position of the sleeve 66 shown by the solid lines in FIG. *2b*, the sleeve prevents radial outward displacement of the ball keys 82 to a position which would permit withdrawal of the fishing head 39 from the bore 76. However, in response to motor operated movement of the shaft 38 to move the sleeve 66 to the alternate position shown by the dashed lines in FIGS. *2a* and *2b*, the annular recess 70 is aligned with the openings 80 to permit radial outward movement of the ball keys 82 sufficient to permit withdrawal of the fishing head from the inner sleeve 72. Thanks to the generous length of the groove 52, the fishing head 39 does not require complete insertion into the bore 76, whereby the surfaces 46 and 47 are in registration, in order for the ball keys to prevent disengagement of the fishing head from the tool 30 once the sleeve 66 has been actuated to move to the ball key lock position. In this way, any accumulation of debris in and around the bore 76 which might normally prevent complete insertion of the head into the bore does not preclude coupling of the tool 30 to the fishing head 39.

The operation of the afore-described apparatus is believed to be readily understandable from the description of the working parts. However, briefly, when it is desired to lower a device such as the instrument 26 into wellbore 12 and connected to the tool 30, the head 39 is threadedly coupled to the instrument 26 and inserted into the bore 76 with the sleeve 66 in its retracted position, as shown by the alternate position or dashed lines in FIGS. *2a* and *2b*. Once the ball keys 82 are capable of registration with the groove 52, the sleeve 66 is actuated to move to the solid line position shown in FIGS. *2a* and *2b* to retain the ball keys 82 in the groove 52. With the fishing head 39 suitably locked to the tool 30, the instrument 26 may be lowered into the wellbore until reaching the position desired whereby the motor means 36 is actuated to move the sleeve 66 axially to a position wherein the recess 70 is aligned with the ball keys 82 and they are free to be radially displaced outwardly in response to an axial pulling force on the tool 30 in an effort to separate the tool from the fishing head 39. The tool 30 and the wireline 20 may then be retrieved for use in placing additional instruments in the wellbore or for using in retrieving the instrument 26 at a later time.

Retrieval of the instrument 26 utilizing the motorized tool 30 is believed to be readily understandable from the foregoing description of the construction and operation of the tool 30 and head 39. Thanks to the configuration of the head 39 and the guide member 44, there is little need to be concerned about centralization of the instrument in the wellbore since the guide surface 46 and the outer diameter of the guide member 44 suitably provide for centrally locating the tool 30 in the wellbore and capturing the head 39 once the nose piece 50 is engaged with the guide member 44. The guide member 44 may, of course, be easily replaced by similar guide members, not shown, having different outer diameters and correspondingly larger or smaller conical bore portions for guiding the nose of the fishing head. Still further, thanks to the generous provision of the openings 60, the ports 71, the ports 73, and the axial slots 58, the presence of fluid in the wellbore and within the interior of the fishing tool 30 will not affect the performance of the tool since this fluid may be displaced easily into and out of the respective tool interior spaces during operation of the tool to couple and uncouple with respect to the fishing head 39. The tool 30 and the fishing head 39 may be formed of conventional engineering materials and using conventional fabrication processes familiar to those of skill in the art of wellbore tools and equipment.

Although a preferred embodiment of the present invention has been described in some detail herein, those skilled in the art will recognize that various substitutions and modifications may be made to the embodiments shown without departing from the scope and spirit of the invention as recited in the appended claims.

What we claim is:

1. A fishing tool for retrieving an article located in a wellbore, wherein said fishing tool may be lowered into said wellbore by means connected to one end of the fishing tool, said fishing tool comprising:

an elongated tubular body;

an inner sleeve member secured to said body and extending axially within said body, said inner sleeve member including an axially extending central bore and a plurality of circumferentially spaced openings formed on said sleeve member and opening into said bore;

a ball key disposed within each of said openings and movable at least partially into said bore in locking registration with a fishing head connected to said article;

an outer sleeve member disposed in sleeved relationship around said inner sleeve member and movable axially between first and second positions with respect to said inner sleeve member, said outer sleeve member being operable to prevent, in said first position, radial outward movement of said ball keys out of said bore, said outer sleeve member including recess means formed thereon such that in said second position of said outer sleeve member said recess means is adjacent to said circumferentially spaced openings to allow limited radial outward movement of said ball keys; and means for axially moving said outer sleeve member between said first and second positions for engaging and releasing said fishing head with respect to said tool.

2. The tool set forth in claim 1 including:

a guide member disposed at one end of said tool for guiding said fishing head into said bore in said inner sleeve member.

3. The tool set forth in claim 2 wherein:

said guide member includes a generally conical guide surface for engaging said fishing head for guiding said fishing head into said bore.

4. The tool set forth in claim 3 wherein:

said guide member has an outer cylindrical surface dimensioned to be slightly less than the diameter of means in said wellbore in which said tool is disposed for guiding said tool into registration with said fishing head.

5. The tool set forth in claim 1 wherein:

said body, said outer sleeve member and said inner sleeve member each include port means formed therein to permit the flow of wellbore fluid through said tool from said bore.

6. A fishing tool for retrieving an article located in a wellbore, wherein said fishing tool may be lowered into said wellbore by means connected to one end of said fishing tool, said fishing tool comprising:

an elongated tubular body;

an inner sleeve member secured to said body and extending axially within said body, said inner sleeve member including an axially extending central bore and plural circumferentially spaced openings formed on said sleeve member and opening into said bore;

a ball key disposed in each of said openings and movable at least partially into said bore in locking registration with a fishing head connected to said article, said fishing head including means forming a circumferential groove for receiving said ball keys;

an outer sleeve member adapted to be disposed in sleeved relationship over said inner sleeve member and to prevent, in a first position, radial outward movement of said ball keys out of said bore and in a second position to allow radial outward movement of said ball keys;

a guide member disposed at one end of said tool for guiding said fishing head into said bore in said inner sleeve member; and means for axially moving said outer sleeve member between said first and second positions for engaging said fishing head with respect to said tool.

7. In combination, a fishing tool for retrieving an article located in a wellbore, wherein said fishing tool may be lowered into said wellbore by means connected to one end of said fishing tool and a fishing head adapted to be connected to an article to be placed in and retrieved from said wellbore; said fishing tool comprising an elongated tubular body, an inner sleeve member secured to said body and extending axially within said body, said inner sleeve member including an axially extending central bore and plural circumferentially spaced openings formed on said sleeve member and opening into said bore, a ball key disposed in each of said openings and movable at least partially into said bore in locking registration with said fishing head, an outer sleeve member adapted to be disposed in sleeved relationship over said inner sleeve member and to prevent, in a first position, radial outward movement of said ball keys out of said bore and in a second position to allow radial outward movement of said ball keys, a guide member disposed at one end of said tool for guiding said fishing head into said bore in said inner sleeve member, said fishing head comprising a generally cylindrical member including a frustoconical nose part adapted to engage said guide member for guiding said fishing head into said bore, and means forming a circumferential groove for receiving said ball keys; and means for axially moving said outer sleeve member between said first and second positions for engaging said fishing head with respect to said tool.

* * * * *